United States Patent [19]

Sutherland et al.

[11] 3,942,631

[45] Mar. 9, 1976

[54] MULTI-UNIT PACKAGING METHOD AND PACKAGE

[75] Inventors: Robert L. Sutherland, Sloatsburg, N.Y.; Frederick E. Naumann, Old Tappan, N.J.

[73] Assignee: Federal Paper Board Company, Inc., Montvale, N.J.

[22] Filed: Dec. 5, 1974

[21] Appl. No.: 529,703

[52] U.S. Cl. ..... 206/44.12; 53/37; 206/154; 206/161; 229/51 DB; 229/51 TS

[51] Int. Cl.[2] ..... B65D 5/54; B65D 81/36

[58] Field of Search ..... 229/40, 51 R, 51 S, 51 D, 229/51 DB, 51 TS; 206/44.12, 45.12, 145, 151, 152, 154, 161; 53/37, 48, 49

[56] References Cited

UNITED STATES PATENTS

| | | | |
|---|---|---|---|
| 2,502,561 | 4/1950 | Ebert | 206/45.12 X |
| 3,043,490 | 7/1962 | Burnett | 229/51 DB X |
| 3,186,545 | 6/1965 | Courades | 229/40 X |
| 3,373,867 | 3/1968 | Wood | 229/40 X |
| 3,469,766 | 9/1969 | Nelson | 229/51 S |
| 3,495,704 | 2/1970 | Richards et al. | 229/40 X |
| 3,552,082 | 1/1971 | Howard | 229/40 X |
| 3,653,495 | 4/1972 | Gray | 229/51 TS X |
| 3,669,251 | 6/1972 | Phillips, Jr. | 229/51 TS X |
| 3,884,348 | 5/1975 | Ross | 206/45.12 |

*Primary Examiner*—William T. Dixson, Jr.
*Assistant Examiner*—Stephen Marcus
*Attorney, Agent, or Firm*—Guy A. Greenawalt

[57] ABSTRACT

A system for supplying to jobbers, in packaged form, quantities of bottled or canned beverages, or other products, similarly packaged, which enables the jobbers to readily convert the cartons, in which the packaged products are shipped, into display cases or trays, by removing portions of the shipping containers without disturbing the contents, so as to display and provide access to the multi-unit packages, and wherein the multi-unit packages are formed by tightly wrapping a cut and scored paperboard blank about the top, bottom and sides of an assembly of the bottles or cans which wrapper blank is provided with tear lines or areas near the bottom on opposite sides of the wrapper which enable the major portion of the wrapper to be torn off by an upward pull on top portions of the wrapper without the need for access to the sides thereof and which leaves the individual bottles or cans undisturbed but accessible for ready removal individually.

6 Claims, 11 Drawing Figures

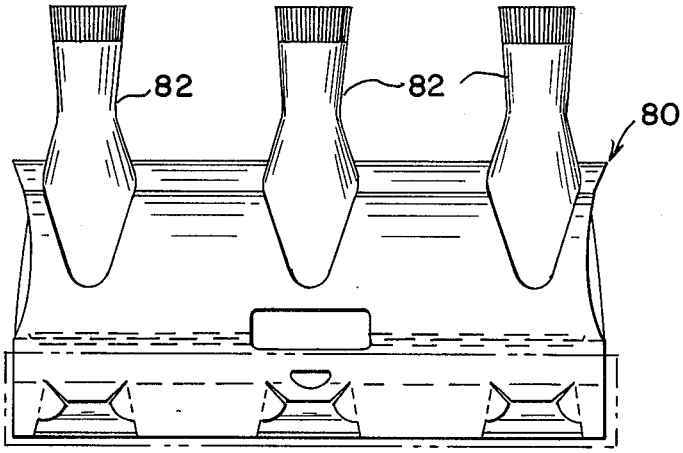
FIG. 9
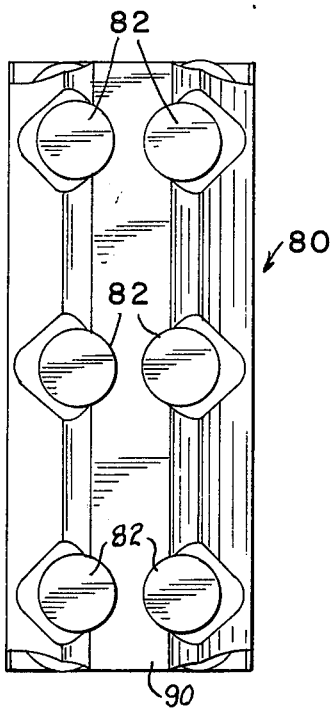
FIG. 10
FIG. 11
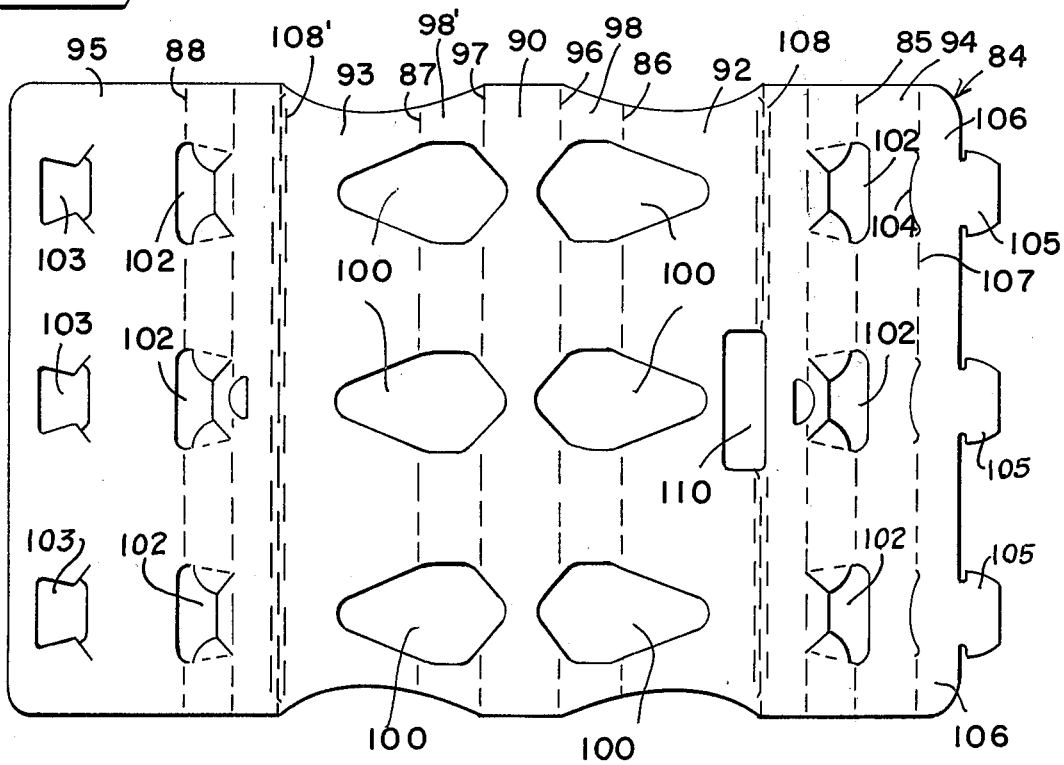

MULTI-UNIT PACKAGING METHOD AND PACKAGE

This invention relates to packaging systems adapted to be employed in the marketing multi-unit packaged products, such as, bottled or canned beverages or other liquid products in containers having the form of bottles or cans and is more particularly concerned with improvements in a method and a means for enabling a manufacturer to furnish multi-unit packages of a product to jobbers for distribution to smaller outlets in the multi-unit packages or as loose single product items, out of one inventory.

In the marketing of a number of packaged products, such as, for example, bottled and canned beverages and other liquid products packaged in bottles and cans, several different multi-unit packaging systems have been developed to satisfy the needs of the manufacturer's customers and the desires of the ultimate retail purchaser who is generally the product consumer. Most often, the desires or convenience of the retail customer have been controlling and the jobber, who stands between the manufacturer and the retail outlet, has been forced to tailor his operations to fit his customers's desires. The familiar multi-unit bottle or can package, generally referred to as the 6-Pak package, which comprises six bottles, or cans, tightly enclosed in a wrap-around paperboard blank, has been developed, in numerous forms, to satisfy the desire of the retail customer for a multi-unit package which is readily handled with little risk of damage or disassembly while presenting no problem with respect to ready removal of the individual units, when desired. However, the problem of the jobber in maintaining an adequate inventory or stock of items for distribution has been rendered more difficult of solution. It is a general object, therefore, of the present invention to provide a method and a means for alleviating the jobber's inventory problem while retaining the 6-Pak idea which the ultimate customer or consumer generally finds most convenient.

It is a more specific object of the invention to provide a packaging system for use in marketing bottled or canned products which enables the manufacturer or producer of the single item products to supply a jobber customer with a plurality of 6-Pak units in a shipping container which is convertible into a display unit upon opening, and with the 6-Pak units constructed so as to be readily opened by the jobber without removal of the units from the shipping container, thereby enabling the jobber to supply either the 6-Pak units or individual single packaged units to his customers while maintaining minimum inventory.

A still more specific object of the invention is to provide a packaging system for distribution to a jobber, or the like, or multi-unit packages of canned or bottled products wherein the multi-unit packages are provided for incorporation in a shipping container which is convertible, upon opening, into a display unit with open top and front and partially open sides, or into a relatively shallow bottom tray, with the multi-unit packages having readily separable top and side wrapper portions which may be removed without removing the multi-unit packages from the tray-like container, thereby providing a multi-unit display of the individual package units and ready access for removal of single package units from the shipping container.

Another object of the invention is to provide a packaging system for products such as, for example, bottled or canned beverages, wherein a plurality of the bottles or cans are arranged in double row, transversely aligned pairs, in a wrapper which encircles the bottles or cans at the top, bottom and outer sides of the assembly and which has a tear line area or strip arrangement extending generally parallel with the bottom and spaced a short distance from the bottom in each side wall thereof, which tear line area is perforated by interrupted cutting lines of a character which enables the top wall and major portions of both side walls to be torn off by an upward pull thereon so as to expose the upper and major portions of the bottles or cans without the need for access to the side walls.

These and other objects of the invention will be apparent from a consideration of the packaging system and the several package formations which are shown by way of illustration in the accompanying drawings wherein:

FIG. 9 is a side elevational view of a multi-unit package of a bottled product which may be enclosed in the shipping container to form a package of the same character as shown in FIG. 1;

FIG. 10 is a top plan view of the package of FIG. 9; and

FIG. 11 is a plane view of a paperboard blank which is cut and scored for use in forming the package of FIGS. 9 and 10.

Figure 1:
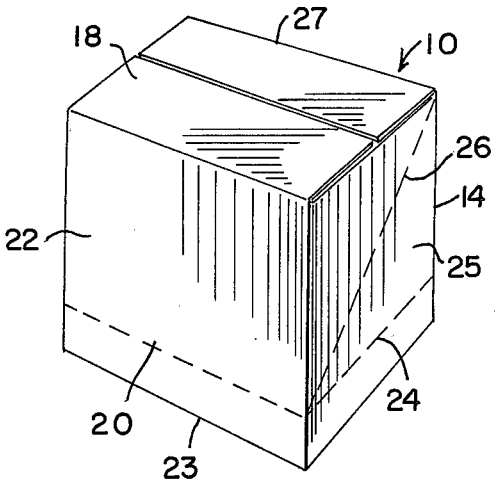
FIG. 1 is a perspective view of a package which embodies the principal features of the invention.
Figure 2:
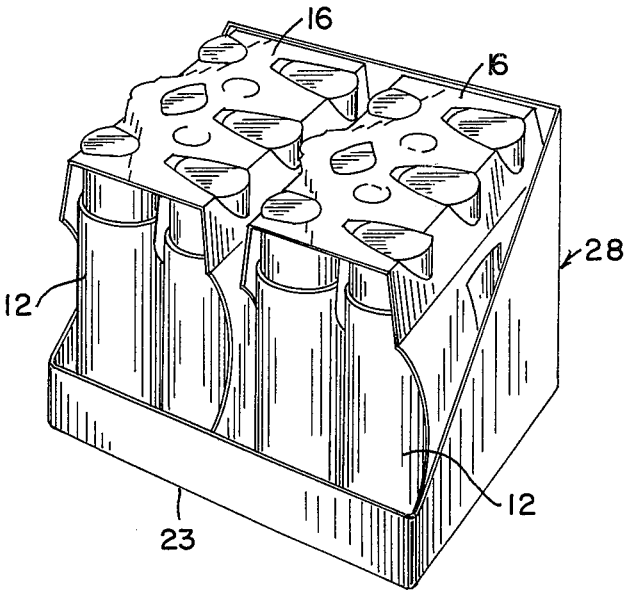
FIG. 2 is a perspective view of the package of FIG. 1 with a portion of the shipping container torn away so as to convert the same to a display tray and provide access to the two multi-unit packages enclosed in the outer container.
Figure 3:
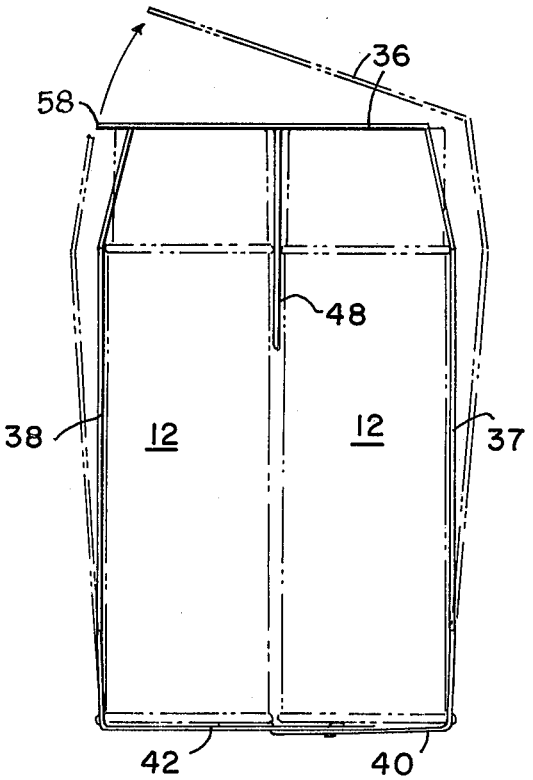
FIG. 3 is an end elevational view of one of the multi-unit can packages which are enclosed in the outer container to form the package of FIG. 1.
Figure 4:
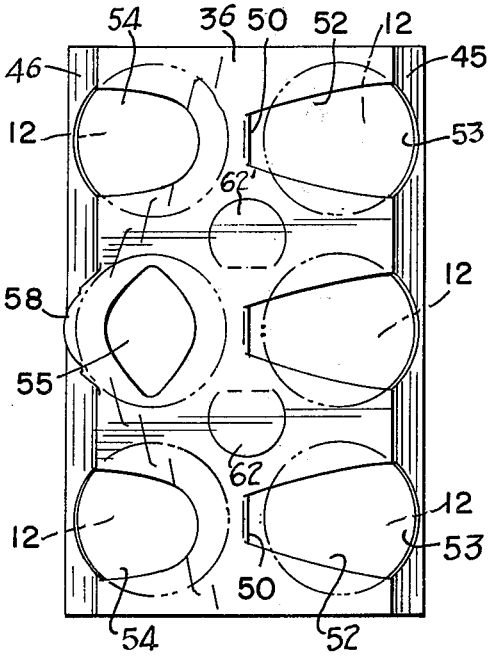
FIG. 4 is a top plan view of the can package of FIG. 3.

Referring first to FIGS. 1 and 2, there is illustrated a package unit 10 adapted to be furnished by the manufacturer to a jobber for distribution to the jobber's customers which incorporates the principal features of the invention as applied in connection with the marketing of canned products. In the form shown, the individual product units 12 may be, for example, aerosol cans of the type which may be filled with any one of a large number of personal grooming products which are commercially available. The individual product units 12 are each part of a six unit package 14 formed by wrapping a paperboard blank about a cluster of six cans arranged in double row, transversely paired relation and generally referred to as a 6-Pak, there being two of the multi-unit packages set into the outer container 16 which serves as a shipping container.

The shipping container 16 is preferably formed of a corrugated board of suitable weight. It is fabricated to be set up as an open ended tube with pairs of closure forming flaps at top and bottom, only the top closure flaps 18 being shown in FIG. 1. The container 16 is provided with a cutting or tearing line 20 in the front wall forming panel 22, as viewed in FIG. 1, which is generally parallel with the bottom edge or corner 23 and spaced a short distance above the same. The cutting or tearing line 20, which may be a line of spaced perforations or a marking line for cutting with a knife, is extended or continued about the end and back side walls, as indicated at 24 in the one end wall 25 which is visible in FIG. 1. The oppositely disposed ends walls are also provided with a diagonal cutting or tearing line, one of which is indicated at 26 in the one end wall 25. A cutting or tearing line (not shown) may be indicated at or adjacent the top rear edge 27. The indicated cutting or tearing lines in the front and back side walls and the diagonal cutting or tearing lines in the end walls enable the top and a portion of the side walls to be torn or cut away so as to convert the shipping container 16 into the display case 28 of FIG. 2, with the multi-unit packages 14 remaining in the case but visible in part and accessible for removal from the case.

Figure 7:
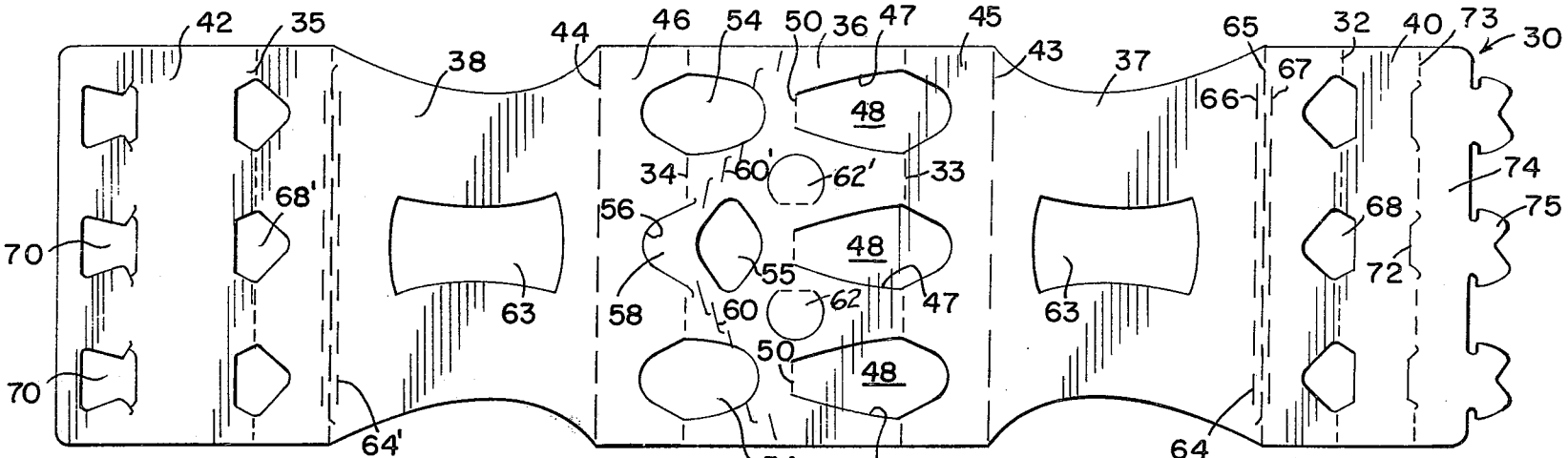
FIG. 7 is a plan view of a paperboard blank which is cut and scored to form the can package of FIG. 3.

The multi-unit packages 16 are each formed by folding about a double row of transversely aligned cans 12, a wrapper forming rectangular blank 30, of paperboard or similar foldable sheet material, which is cut and scored, or creased, as shown in FIG. 7 of the drawings and which is tightly drawn about the cans while the ends thereof are secured so as to enclose the assembly and securely lock the cans in the open ended tubular container thus formed.

Figure 6:
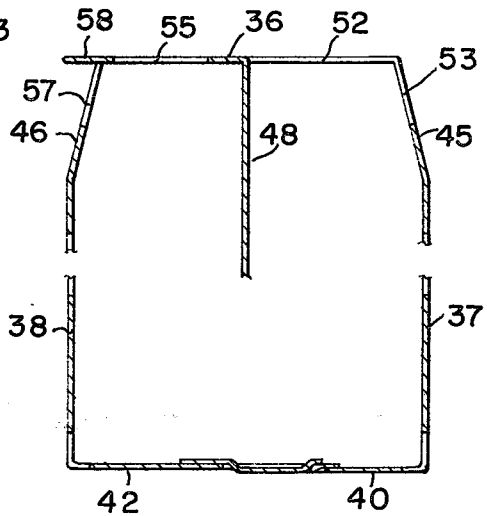
FIG. 6 is a vertical cross sectional view, taken on line 6—6 of FIG. 5, with portions broken away and with the cans omitted.
Figure 5:
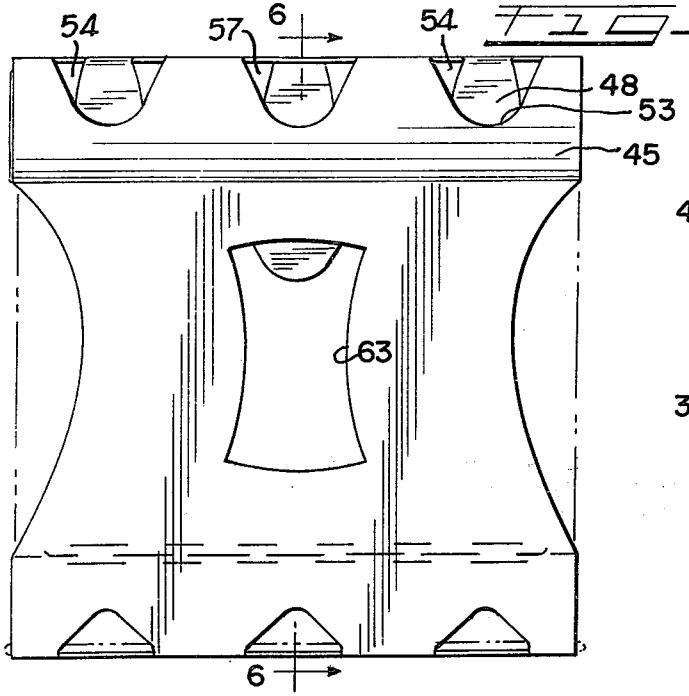
FIG. 5 is a side elevational view of the package of FIG. 3, the end cans only being indicated in phanthom line.

The wrapper forming blank 30 is divided by longitudinally spaced, transverse, edge forming score lines 32, 33, 34 and 35 into a center top wall forming panel 36, adjoining side wall forming panels 37, 38 and bottom wall forming and locking panel sections 40 and 42. The side wall forming panels 37 and 38 are subdivided by transverse score lines 43 and 44 which are spaced from the score lines 33 and 34 a sufficient distance to provide the package with relatively narrow, inwardly slanted panel portions 45 and 46 at the top of the side walls, as shown in FIG. 6, for better confining the top portions of the cans. The panel 36 is cut along one side on transversely spaced lines 47 each of which have generally U-shaped configuration, as shown in FIG. 5, and which extend into the panel 45 with the cut out portion forming a bottle separating tab 48 (FIGS. 3, 5, 6 and 7) adapted to be hinged downwardly about a score line 50 which coincides with the center line of the panel 36 and which results in an aperture with a portion 52 (FIGS. 2 and 6) in the top wall forming panel 36 for exposing part of the top of the associated can 12 and a portion 53 in the slanted panel 45 in which a portion of the top of the associated can is seated when the package is formed so as to lock the same against movement in the package. At the other side of the panel 36 transversely spaced end apertures 54 and center aperture 55 are cut with the configuration shown in FIG. 7. The outside or end apertures 54 each extend into the adjoining slanted side wall panel portion 46 and serve to expose the top portion of the associated can and provide a seat for the outside edge of the can top in the same manner as apertures 52, 53. The center aperture 55 is confined to the top panel area. A U-shaped cut 56, largely in the panel 46 and opening toward the aperture 55, provides a center can retaining or locking aperture 57 (FIG. 6) in the side wall panel 46 and also a pull tab formation 58. The pull tap 58 provides a finger grip for co-operation with outwardly diverging tear lines 60 and 60′, of known construction, which facilitates tearing out the top of the package for access to the cans in the normal use of the package. A pair of spaced finger receiving apertures is provided by cutting hinged tab members 62, 62′ on the center line of the panel 36 as shown, for carrying the package. The side wall forming panels 37, 38 are each apertured, as shown at 63, to expose a side wall portion of the center cans for identification, price marking or the like. The side wall panels 37 and 38 are each provided with a transversely extending tearing line or tearing strip formation 64, 64′ of identical construction. As shown, each of the tear line formations is provided by three closely spaced, parallel lines of spaced cuts or slits extending generally parallel to the respective bottom edge fold lines 32 and 35. The center line of slits 65 in the tearing line formation 64 is arranged relative to the two outside lines 66, 67 so that the end portion of each slit overlaps the end portions of the adjacent pair of slits in the two outside lines 66, 67 thereof. This leaves a connecting portion or web of the material between these slit ends that must tear in order to provide separation of the tearing line formation. The uncut portion, in a vertical sense, shears off when sufficient upward pull is exerted on the top panel portion of the wrapper, the shearing action normally occurring with the grain of the paperboard in the conventional paperboard blank arrangement. The connecting portions have sufficient strength to resist separation in the normal handling or lifting of the package by gripping the top panel but will separate when greater than normal upward pull is exerted with the cans restrained against upward movement. This enables the major portion of the wrapper to be removed without there being access to the side wall portions thereof. The wrapper end panel portions 40, 42 each have a line of apertures 68, 68′ interrupting the bottom edge score lines 32, 35 and extending into the side wall and bottom panels for seating therein bottom edge portions of the cans to lock them in the package. The panel 42, which may be considered the female locking panel, is provided with transversely spaced locking apertures for co-operation with primary locking tab formations on the inside fold line 73 of the locking panel 74 and the secondary locking or latching tabs or fingers 75 spaced along the outside edge of the panel 74. The panel locking arrangement may be according to the panel locking arrangement in U.S. Pat. No. 3,556,386, granted Jan. 19, 1971 to Robert H. Ganz to which reference may be had for details thereof not herein disclosed.

Figure 8:
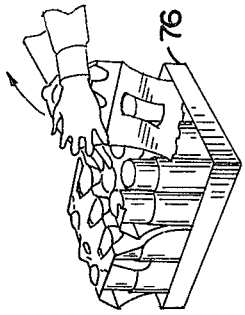
FIG. 8 is a schematic perspective view illustrating the manner in which a portion of the wrapper is removed from the one multi-unit package.

The package 16 is formed by wrapping the cut and scored blank 30 about a cluster or assembly of six cans 12 arranged in two rows with pairs thereof aligned transversely and connecting the bottom wall forming panels 40 and 42 by manipulating the locking panel 74 so as to engage the primary and secondary locking elements 72 and 75 in the co-operating locking apertures 70, resulting in a package of the familiar 6-Pak type. The resulting package 16 may be handled and the contents removed in a conventional manner. It also be packaged for shipment in the carton 14 which enables the jobber or other customer to remove the top portion of the carton 14 so as to provide the display type tray arrangement shown in FIG. 2 or alternatively to tear off and remove the major portion of the shipping container 14 along the tearing or cutting lines 20, 24 leaving a shallow bottom support tray 76 as shown in FIG. 8, and providing easy access to the well displayed packages 16. In addition, the major portion of the wrapper may be readily removed without removing the packages 16 from either the display case 28 or the support tray 76, thus freeing the individual cans 12 for removal one by one from the case 28 or tray 76. This may be readily and easily accomplished in a convenient manner by tearing the top panel 36 open along the tear lines 60, 60' and grasping each of the side wall panels 37, 38 in turn along the top margin, which is rendered accessible, and exerting an upward pull while restraining the cans, as illustrated in FIG. 8. One or both of the packages 16 may, of course, be opened without removal from the converted shipping container.

Referring to FIGS. 9, 10 and 11, there is illustrated a modified multi-unit package 80 which is adapted for use in practicing the present invention. The package 80 comprises a group or cluster of six bottled product units 82 which are arranged in double row, transversely aligned pairs and enclosed in a wraparound type blank 84 of foldable paperboard or other suitable material, which is cut and scored as shown in FIG. 11.

The wrapper or carton forming blank 84 which is of generally rectangular shape is divided by parallel, longitudinally spaced, transverse score lines or crease lines, 85, 86, 87 and 88 into a center top wall forming panel 90, adjoining side wall forming panels 92, 93 and bottom wall forming end panels 94, 95. The top wall forming panel 90 is subdivided by parallel, spaced, transverse score lines 96, 97 so as to permit the side panel portions 98, 98' between the score lines 96, 86 nad 97, 87 to slant outwardly of the center portion of the panel when wrapped about the bottles 82. The top wall panel 90 is provided with two lines of transversely spaced bottle neck receiving apertures 100 each having the configuration shown in FIG. 11, which apertures extend into the side wall panels 92 and 93. The score lines 85 and 88 which form the bottom side edges of the package are interrupted by transversely spaced bottle heel accommodating openings or apertures 102 which are formed by cutting and scoring as shown most clearly in FIG. 11. The openings or apertures 102 extend a short distance into the bottom wall forming end panels 94 and 95 and a greater distance into the adjoining side wall forming panels 92 and 93 for receiving the outermost bottom edge portions of the bottles. The apertures 102 may be formed in various ways depending upon the configuration of the bottles which are enclosed in the wrapper. The one end panel 95, which may be considered the female panel, is provided with a line of transversely spaced apertures 103 for co-operation with primary locking tabs 104 and secondary locking or latching fingers or tabs 105, which tabs are spaced along opposite edges of a relatively narrow locking panel 106, the latter being divided from the blank end panel 94 by the hinge forming crease line 107. The locking or latching arrangement for connecting the bottom wall forming panels 94 and 95 may be constructed according to the arrangement described in U.S. Pat. No. 3,556,386. The side wall forming panels 92 and 93 are provided with tearing lines or tearing strip areas 108, 108' of identical construction and each spaced a relatively short distance from the bottom edge fold lines 85 and 88 in the direction of the center top wall forming panel 90, so that, in the package 80, as shown in FIG. 9, they are spaced a relatively short distance above the bottom wall and in generally parallel relation with the same. The tearing lines or tearing strip areas 108, 108', as shown, are formed by spaced parallel lines of slits arranged in the same manner as described with respect to slits 65, 66 and 67 in the blank of FIG. 7. Two lines of the slits with adjacent ends overlapping may be sufficient but the illustrated three lines have been found most effective. An opening may be provided in one or both of the side wall panels 92 and 93 as shown at 110 rendering visible a portion of the side wall of the center bottle 82, and enabling identification of the product name, or the like.

The package 80 is formed by assembling the bottles, which, in the form shown, are odd shaped, in the sense that they are non-cylindrical, in double row, transversely aligned relation, and wrapping the cut and scored blank 84 about a group or cluster of six individual bottles and securing and locking the bottom wall panels 94, 95 by manipulating the locking panel 106 on the male panel 94 so as to engage the primary and secondary locking and latching tabs 104, 105 in the co-operating apertures 103 in the female panel 95.

The package 80 is adapted to be enclosed with a like package 80 in an outside shipping container 14 which may be opened by removing a portion thereof so as to leave the remainder as a display case 28 (FIG. 2) or a support tray 76 (FIG. 8). The packages 80 may be readily and easily opened by merely exerting an upward pull on the end margins of the top panel 90 while restraining the end pairs of bottles 82 against upward movement so as to cause separation of the top side wall portions along the tearing lines or strip areas 108, 108', enabling the top and major portion of the wrapper to be removed, without any need for access to the side wall areas and without removal of the package from its original position in the shipping container. Removal of the major portion of the wrapper, of course, provides access to the bottles for ready removal of individual bottles from the display case or tray.

We claim:

1. A method of packaging for use in supplying bottled or canned products to a distributor which comprises enclosing a group of the individual product units, which are arranged in double row, transversely aligned pairs, in a wrapper forming blank, which blank is cut and scored to provide a package having a top wall, oppositely disposed side walls, and a bottom wall, with both side walls of said package having tear strip areas adjacent the bottom side edges thereof, which tear strip areas are formed so as to resist tearing under normal lifting of the package by grasping the top wall while enabling the top portions of both side walls to be torn loose by an upward pull which applies an upwardly directed force to the top portion of each side wall while upward movement of the product units is restrained, and enclosing one or more of the packaged groups in a shipping container of the tubular type having bottom and top closure elements and having in the peripheral side walls tearing or cutting lines which enable the uppermost portion of the container to be readily separated and removed from the remainder thereof so as to leave a display tray with the contents remaining therein and the top portions thereof exposed for ready removal of the entire top portions of the package wrapper, when desired, without removal of the package from the tray and without full access to at least one of the wrapper covered side walls of the package.

2. A method of packaging as set forth in claim 1 which includes providing tearing or cutting lines in the side walls of said shipping container which are substantially parallel with the bottom edges of said container and spaced a short distance above the bottom thereof so as to enable said uppermost portion of the container, including top portions of the side walls, to be torn away and to leave a bottom tray of relatively shallow depth without disturbing the contents.

3. A method of packaging as set forth in claim 1 which includes providing tearing or cutting lines in the side walls of said tubular shipping container which are, in part, parallel with bottom edges of said shipping container, and, in part, diagonal, so as to extend, in oppositely disposed walls, in an upward direction from one adjoining side wall toward an oppositely disposed side wall, whereby to enable said uppermost portion of the container to be torn away and to leave a tray formation with a relatively low front wall, a much higher back wall and generally triangular shaped connecting side walls.

4. A package comprising an outer shipping container of generally tubular form with top and bottom closure flaps connecting the top and bottom edges of peripheral side walls, said side walls having tearing or cutting lines which enable the topmost portions of said container to be readily separated from the bottommost portions so as to leave an open tray and expose the contents, and one or more packages of product units in the form of bottles or cans enclosed in said shipping container, which packages comprise a group of said product units arranged in a row, or in a double row with the product units aligned in pairs transversely, and a wrapper of paperboard, or the like, enclosing said product units which wrapper provides a top wall, depending side walls and a side wall connecting bottom wall, said side walls having tear line formations therein spaced a relatively short distance from the bottom wall which resist tearing under normal lifting of the package by grasping the top wall but which enable the top portions of the wrapper to be torn away by exerting a predetermined upward pull on the top portions of said side wall panels while restraining the upward movement of the product units.

5. A package as set forth in claim 4 wherein said outer shipping container has peripheral side walls with tear line formations paralleling the bottom wall and spaced a short distance above the bottom wall which enable the topmost portion of said container to be torn off, leaving an open top tray of relatively shallow depth.

6. A package as set forth in claim 4 wherein said outer container has peripheral side walls with tearing or cutting line formations which extend, in part, parallel with the bottom wall and, in part, extend diagonally in oppositely disposed side walls so as to enable the top portion of the container to be readily torn away leaving an upwardly open tray with a pair of side walls of unequal height and the adjoining side walls of generally triangular configuration.

* * * * *